US006916001B2

(12) United States Patent
Pugh, Jr.

(10) Patent No.: US 6,916,001 B2
(45) Date of Patent: Jul. 12, 2005

(54) CONCRETE FORM APPARATUS AND METHOD FOR ASSEMBLY THEREOF

(76) Inventor: Lowell Thomas Pugh, Jr., 2313 Golden Meadows Crescent, Nanaimo, British Columbia (CA), V9T 3L9

( * ) Notice: Subject to any disclaimer, the term of this patent is extended or adjusted under 35 U.S.C. 154(b) by 108 days.

(21) Appl. No.: 10/191,300

(22) Filed: Jul. 10, 2002

(65) Prior Publication Data

US 2004/0007658 A1 Jan. 15, 2004

(51) Int. Cl.[7] ..... E04G 11/12; E04G 17/00
(52) U.S. Cl. ..... 249/195; 249/44; 249/219.2
(58) Field of Search ..... 249/190, 195, 249/219.2, 40, 44, 47, 192, 213

(56) References Cited

U.S. PATENT DOCUMENTS

| | | | | |
|---|---|---|---|---|
| 1,151,631 A | * | 8/1915 | Walker | 249/195 |
| 2,075,239 A | | 3/1937 | Strange | |
| 2,679,872 A | * | 6/1954 | Sutcliffe | 249/219.2 |
| 3,035,321 A | * | 5/1962 | Hennig | 249/190 |
| 3,211,413 A | * | 10/1965 | Low, III | 249/190 |
| 3,792,831 A | | 2/1974 | Verhey | |
| 4,553,729 A | | 11/1985 | Connors | |
| 5,562,845 A | | 10/1996 | Miller et al. | |
| 5,968,403 A | | 10/1999 | Myers et al. | |
| 6,237,890 B1 | | 5/2001 | Gates | |

FOREIGN PATENT DOCUMENTS

| | | | |
|---|---|---|---|
| CA | 721684 | * 11/1965 | 249/190 |

* cited by examiner

*Primary Examiner*—Michael Safavi
(74) *Attorney, Agent, or Firm*—Norman M Cameron

(57) ABSTRACT

A concrete form apparatus includes a rectangular panel having first connector elements along a first edge thereof and second connector elements along a second edge thereof. The first connector elements are aligned with the second connector elements and are complementary and structure. The first and second connector elements can connect a plurality of the panels together with the first and second edges thereof adjacent to each other. Third connector elements are connected to the panel in spaced-apart relationship and are engageable with clamps for securing walers to the panel. For example, the first connector elements may be hook-like latches and the second connector elements may be buttons. The third connector elements may be buttons. A plurality of the rectangular panels are arranged adjacent to each other in edge-by-edge relationship. The rectangular panels are connected together. A plurality of first walers are connected to the panels so the first walers are parallel to each other and are spaced-apart from each other. A plurality of second walers are connected to the first walers so the second walers are parallel to each other. The second walers are spaced-apart from each other and are perpendicular to the first walers.

14 Claims, 5 Drawing Sheets

CONCRETE FORM APPARATUS AND METHOD FOR ASSEMBLY THEREOF

BACKGROUND OF THE INVENTION

This invention relates to apparatuses for constructing concrete forms and methods for assembling these forms.

One type of conventional concrete form includes a plurality of horizontal walers connected together by a plurality of vertical walers. Plywood panels are connected to the horizontal walers, typically by nails. For example the horizontal walers may be aluminium beams such as those sold under the trademark Aluma Beam. The vertical walers may be of aluminum or steel. These forms are typically constructed by laying the walers on the ground and squaring up the horizontal and vertical walers. It takes time to properly align the walers so they are spaced apart correctly and so the horizontal walers are perpendicular to the vertical walers. After this job is finished, the plywood panels are nailed to wooden strips along the horizontal walers. This procedure takes considerable time and slows the construction process.

Liners, for example of plastic or elastomeric material, are optionally placed over the plywood panels. In conventional concrete forms these liners must be punctured to allow tie bars to be secured between forms.

Earlier patents reveal various apparatuses for concrete forms of this nature. For example, U.S. Pat. No. 3,792,831 shows a scaffold-waler bracket. The bracket is secured by buttons.

U.S. Pat. No. 2,075,239 shows a concrete form clamp. The clamp has a channel between ears.

U.S. Pat. No. 6,237,890 shows a support apparatus for a concrete form system. FIG. 1 shows a clamp which appears to hold a vertical waler and a horizontal waler together.

U.S. Pat. Nos. 5,968,403 and 4,553,729 show joining systems for abutting concrete form panels.

U.S. Pat. No. 4,553,729 to Connors shows a modular concrete form structure. Each panel has a separate mini-waler.

Despite the prior art, however, there is still a need for an improved apparatus and method for constructing concrete forms which are simpler and save time compared with the systems described above.

It is an object of the invention to provide an improved apparatus and method for constructing concrete forms which do not require walers to be aligned and squared prior to fitting plywood panels to the walers.

It is also an object of the invention to provide an improved apparatus and method for constructing concrete forms where the panels can be connected to the walers releasably without the need for nailing.

It is a further object of the invention to provide an improved apparatus and method for constructing concrete forms where liners to not have to be punctured for tie bars.

SUMMARY OF THE INVENTION

In accordance with these objects, there is provided a method for assembling concrete forms. A plurality of rectangular panels are arranged adjacent to each other in edge-by-edge relationship. The rectangular panels are connected together. A plurality of first walers are connected to the panels so the first walers are parallel to each other and are spaced-apart from each other. A plurality of second walers are connected to the first walers so the second walers are parallel to each other. The second walers are spaced-apart from each other and are perpendicular to the first walers.

Preferably each of the panels has a first edge and a second edge. There is a plurality of spaced-apart first connector elements along each panel adjacent to the first edge. There is a plurality of second connector elements along each panel adjacent to the second edge. The panels are arranged so the first and second edges of adjacent panels are adjacent to each other. The first connector elements of each adjacent panel are releasably connected to the second connector elements of another adjacent panel, thereby connecting the panels together.

There is provided, according to another aspect of the invention, a concrete form apparatus including a rectangular panel having first connector elements along a first edge thereof and second connector elements along a second edge thereof. The first connector elements are aligned with the second connector elements and are complementary and structure. The first and second connector elements can connect a plurality of the panels together with the first and second edges thereof adjacent to each other. Third connector elements are connected to the panel in spaced-apart relationship and are engageable with clamps for securing walers to the panel. For example, the first connector elements may be hook-like latches and the second connector elements may be buttons. The third connector elements may be buttons.

There is provided, according to a further aspect of the invention, a concrete form apparatus including a plurality of adjacent rectangular panels. Each panel has a first edge, a second edge, spaced-apart first connector elements adjacent to the first edge thereof and spaced-apart second connector elements adjacent to the second edge thereof. The first connector elements are aligned with the second connector elements and are complementary in structure. Corresponding first and second connector elements of adjacent panels engage each other and connect the plurality of panels together with the first and second edges thereof adjacent to each other. Third connector elements are connected to each panel in spaced-apart relationship. There is a plurality of spaced-apart first walers extending across the plurality of panels. A plurality of clamps engage to third connector elements of the panels and connect the walers to the panels.

The invention offers significant advantages compared to the prior art. The panels can, in fact, act as guides for installing the walers. Thus it is not necessary to align the walers prior to installing the panels. Instead, connector elements, such as buttons, may be provided on the panels to receive clamps to hold horizontal walers in place. Thus the positioning of the walers is predetermined by the positions of the connector elements. Vertical walers can simply be connected to the horizontal walers. Essentially the process is reversed from conventional systems where the walers are first positioned on the ground and then the plywood panels are nailed in place. Assembly according to the invention is reversed and the panels are first placed on the ground with the walers on top of the panels.

The use of releasable connectors allows the panels to be quickly assembled without the need for nails and also permits the panels to be reused again and again. Also, providing semicircular recesses along the edges of the panels allows tie bars to extend between panels without requiring liners to be punctured. The panels may be dimensioned the same as common liners, that is 10'×4', so that a single conventional liner can fit each panel.

BRIEF DESCRIPTION OF THE DRAWINGS

In drawings which illustrate embodiments of the invention.

DETAILED DESCRIPTION OF THE PREFERRED EMBODIMENTS

Figure 1:
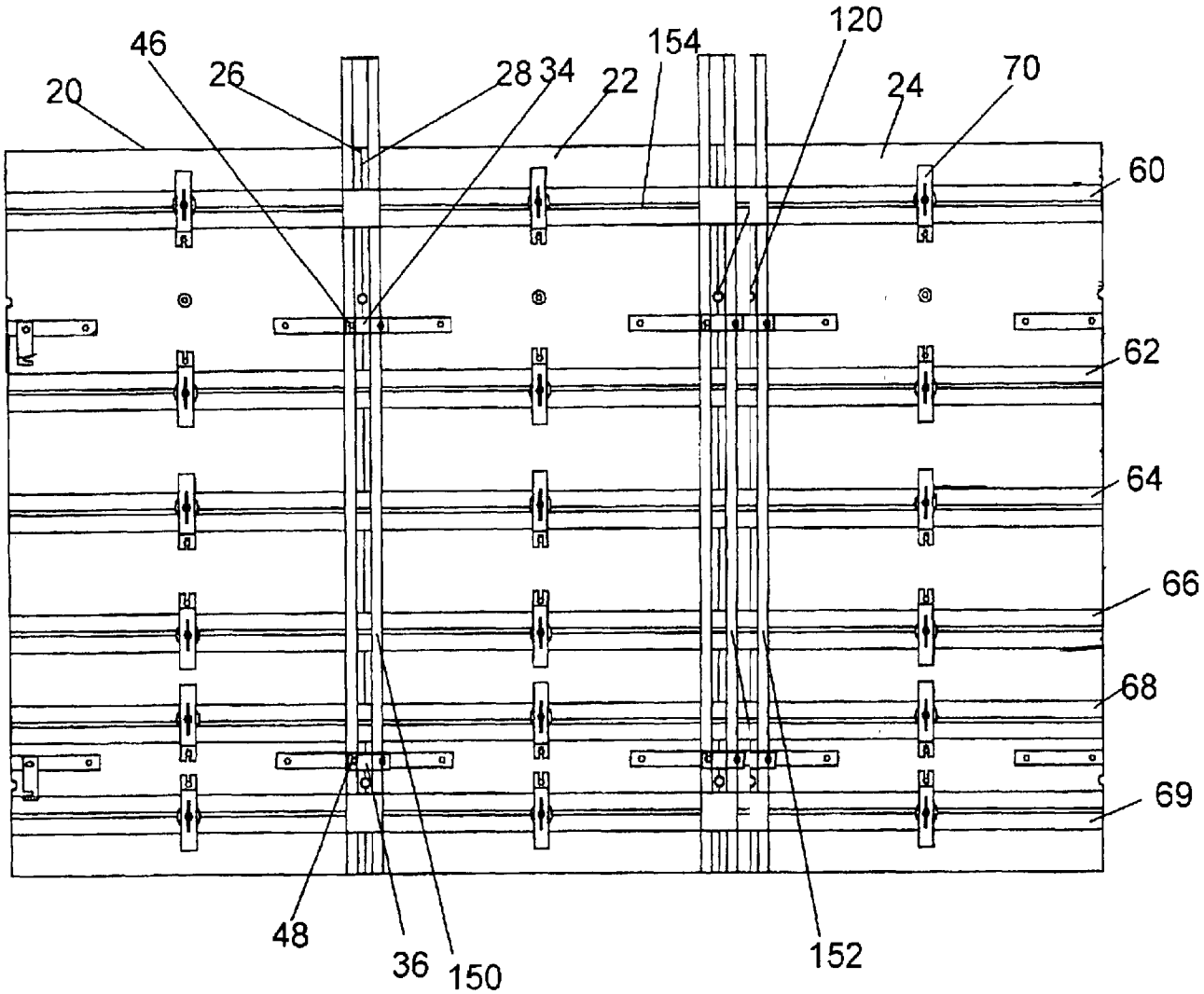
FIG. 1 is an elevational view of a concrete form apparatus according to an embodiment of the invention, showing three adjacent panels with horizontal and vertical walers connected thereto.
Figure 2:
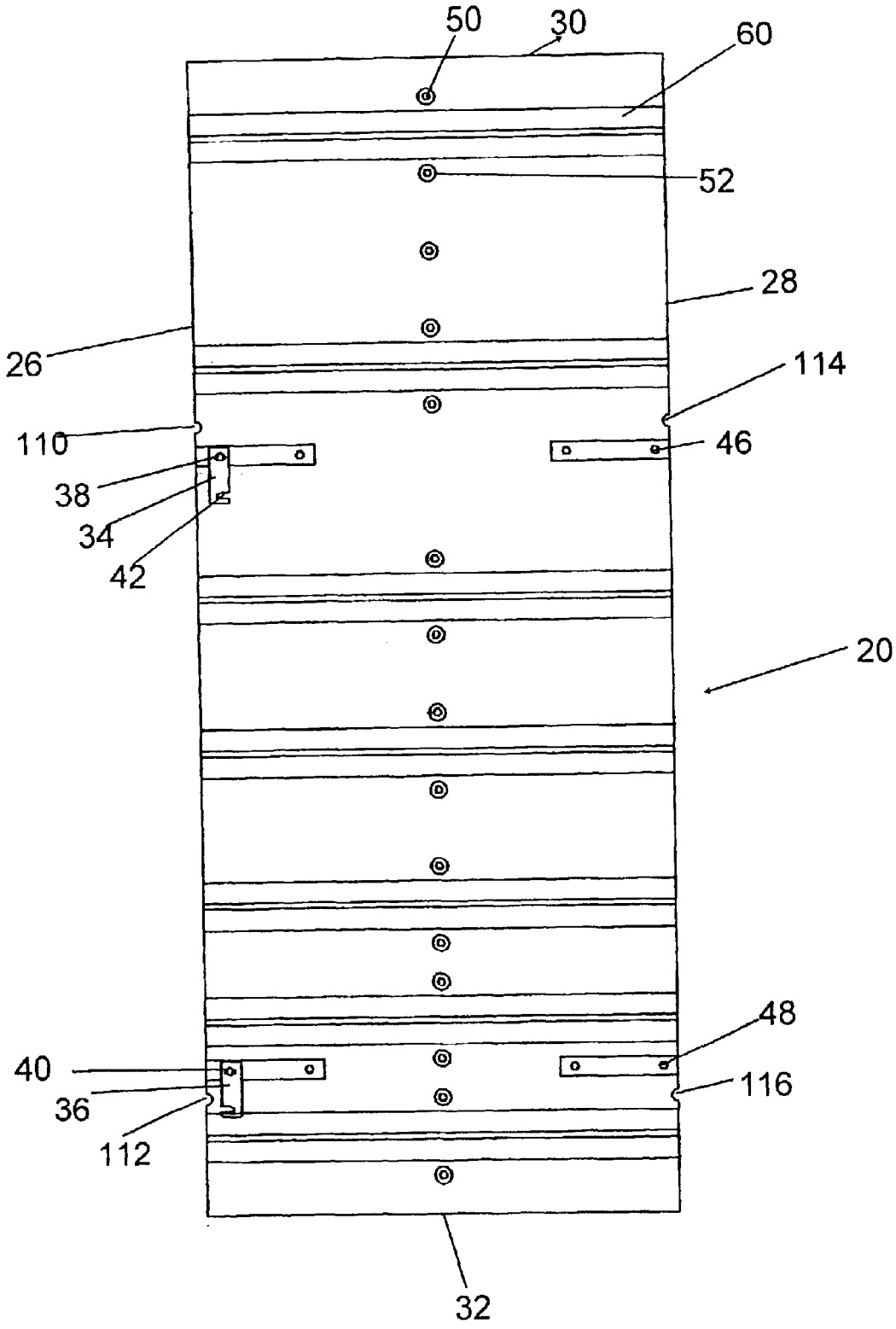
FIG. 2 is an elevational view of one of the panels thereof and fragments of horizontal walers mounted thereon.

Referring to the drawings, and first to FIG. 1, this shows an apparatus for constructing a concrete form which includes three identical panels 20, 22, and 24. One of these panels 20 is shown in FIG. 2. Each panel has a first edge 26 and second edge 28 which are parallel to each other and vertically oriented when the panel is installed on a concrete form. As may be seen, each panel is rectangular and also has a top 30 and a bottom 32. Each panel has first connector elements adjacent to the first edge in the form of a pair of latches 34 and 36 which are pivotally connected to the panel by pins 38 and 40 respectively. Each of the latches is hook-like, having a slot 42 as seen for latch 34. Each panel has second connector elements along edge 28 in the form of a pair of buttons 46 and 48. As may be seen, the latches and buttons are aligned with each other and are complementary in structure so they can connect a plurality of panels together has seen for panels 20, 22 and 24 in FIG. 1. For example, latch 34 on panel 22 engages button 46 on panel 20 and latch 36 on panel 22 engages button 48 on panel 20. Similarly the latches of panel 24 engage the buttons of panel 22. Thus a series of panels can be connected together using the latches and buttons described above. The panels are arranged so first and second edges of adjacent panels are adjacent to each other. For example, edge 26 of panel 22 is adjacent to edge 28 of panel 20 in FIG. 1.

Figure 6:
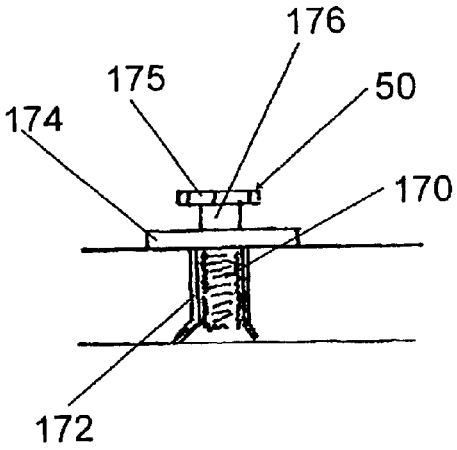
FIG. 6 is a sectional view of one of the panels and a button for connecting the clamp of FIGS. 4 and 5 to the panel.

Each panel also has third connector elements in the form of a series of spaced-apart buttons , such as button 50 seen in FIG. 2. In this embodiment the third connector elements are arranged in a row along the center line of the panel. The buttons are in pairs such as buttons 50 and 52 so as to receive a horizontal waler 60 therebetween. As shown in FIG. 6, each of the buttons comprises a bolt 170 which threadedly engages a female threaded collar 172 extending through the panel. There is a backing plate 174 adjacent to the panel, 2"×2" in this example. A sleeve 176 extends between hex head 175 of the bolt and the backing plate 174.

The panels illustrated above are 10'×4' which allows the use of standard liners as described below. However the panels may be different sizes indifferent embodiments them. Other possible sizes, for example, are 8'×4', 4'×4', and 32"×48".

Figure 4:
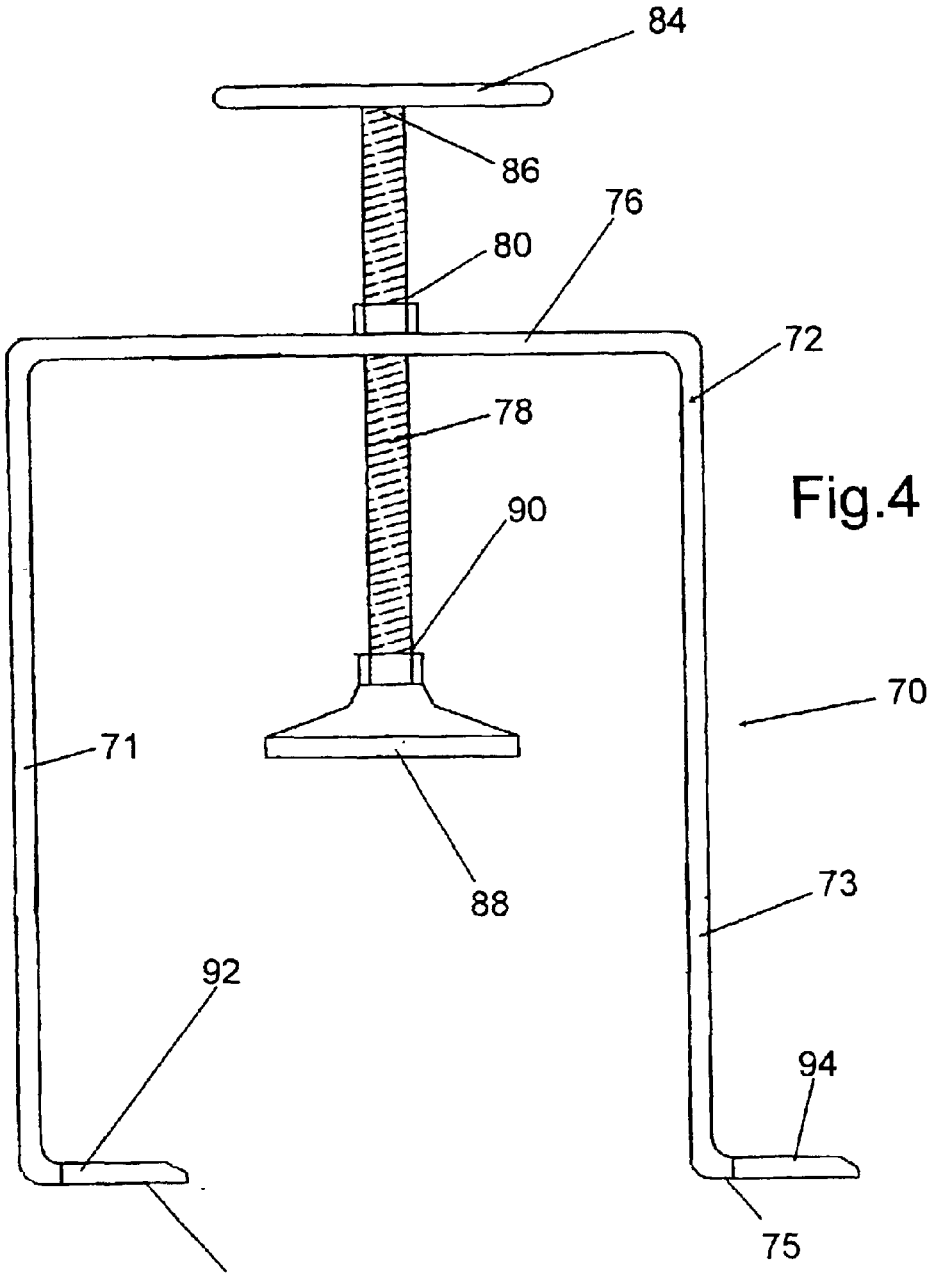
FIG. 4 is a top plan view of a clamp for securing horizontal walers to the panels.
Figure 5:
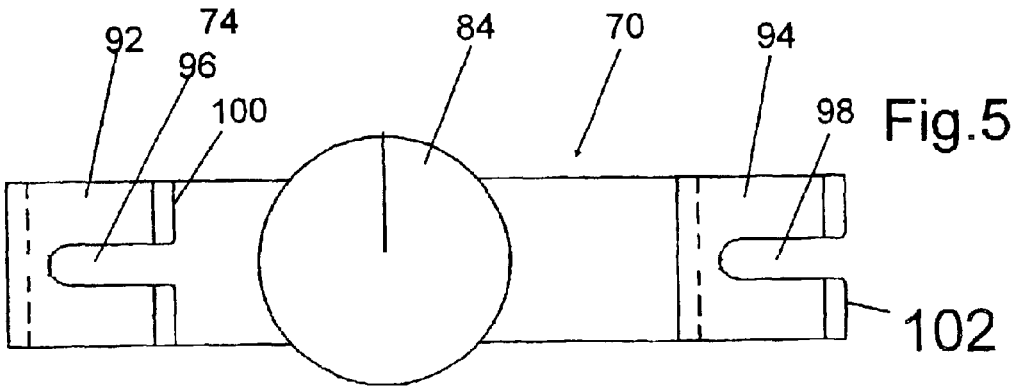
FIG. 5 is an elevational view thereof.

A series of horizontal walers 60, 62, 64, 66, 68 and 69 are connected to the panels so these walers are parallel to each other and are spaced-apart from each other as seen best in FIG. 1. The walers are connected to the panels by a series of clamps 70 which engage the buttons along the center lines of the panels, such as buttons 50 and 52 in FIG. 2. The details of clamp 70 are shown best in FIGS. 4 and 5. Each clamp has a U-shaped body 72 having a pair of legs 71 and 73 with spaced-apart first ends 74 and 75 respectively. The body has a second end 76 with a screw 78 threadedly received in a female threaded aperture 80 on the second end. The screw includes a knob 84 connected to outer end 86 and a pad 88 connected to inner end 90.

The legs 71 and 73 are dimensioned to fit over the horizontal walers. The legs are somewhat L-shaped, having feet 92 and 94 adjacent the ends 74 and 75. Slots 96 and 98 extend inwardly from edges 100 and 102 of the feet. The clamps are placed over horizontal walers and the slots 96 and 98 receive the buttons 50 and 52. The knob 84 is then rotated to tighten pad 88 against the particular horizontal walers to clamp the horizontal walers to the panel. This procedure is repeated for each of the panels and each of the horizontal walers.

Referring back to FIG. 2, each panel has a plurality of spaced-apart recesses along the first edge and the second edge respectively. In this example recesses 110 and 112 occur along edge 26, while recesses 114 and 116 are spaced-apart along edge 28. It may be seen that the recesses along the first edge are aligned with the recesses of the second edge. In this example the recesses are seen to be semicircular. Thus, when the panels are placed together, the recesses form circular apertures between adjacent panels such as aperture 120 of FIG. 1.

Figure 3:
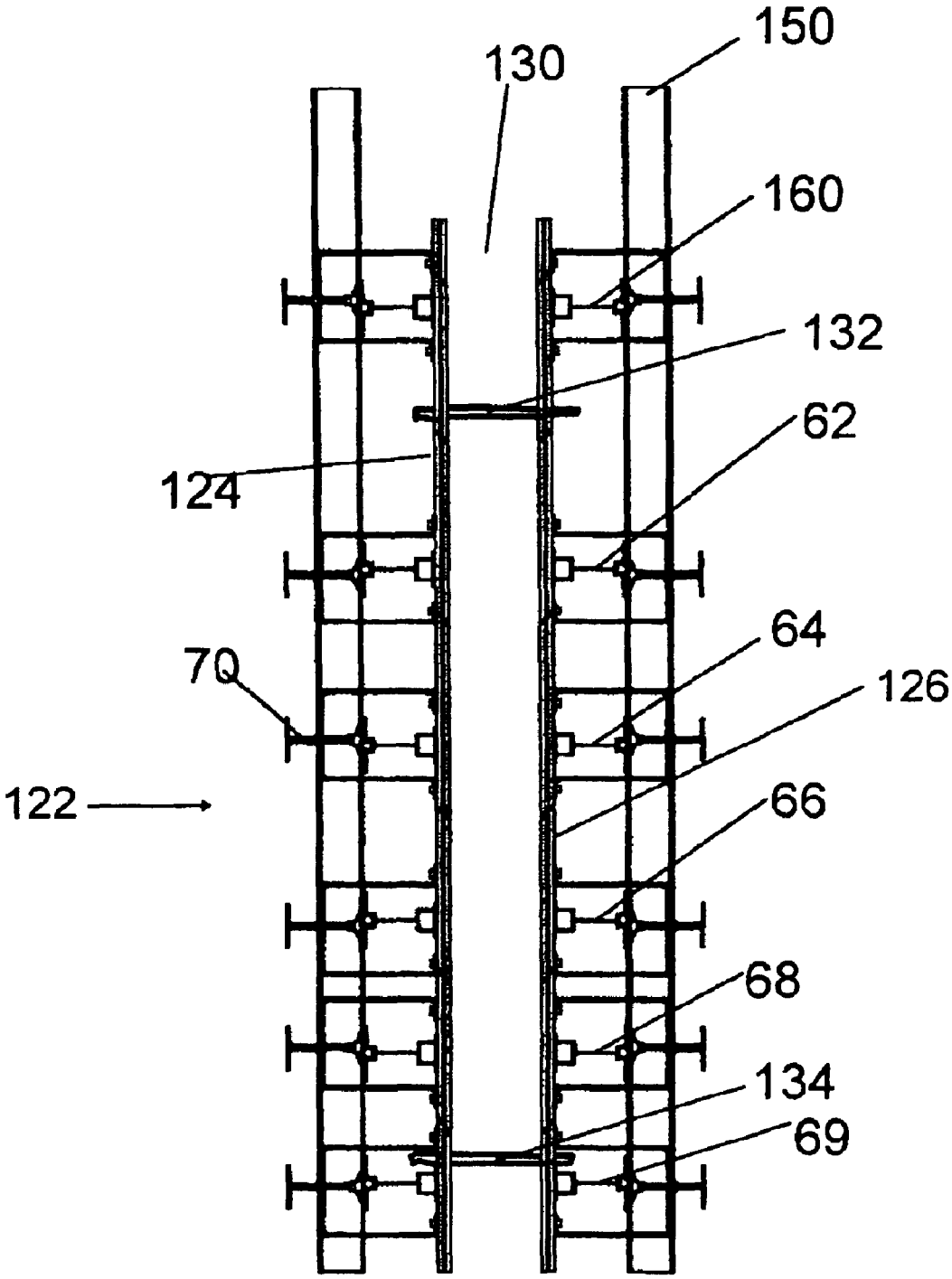
FIG. 3 is an end view of a concrete form according to an embodiment of the invention.
Figure 7:
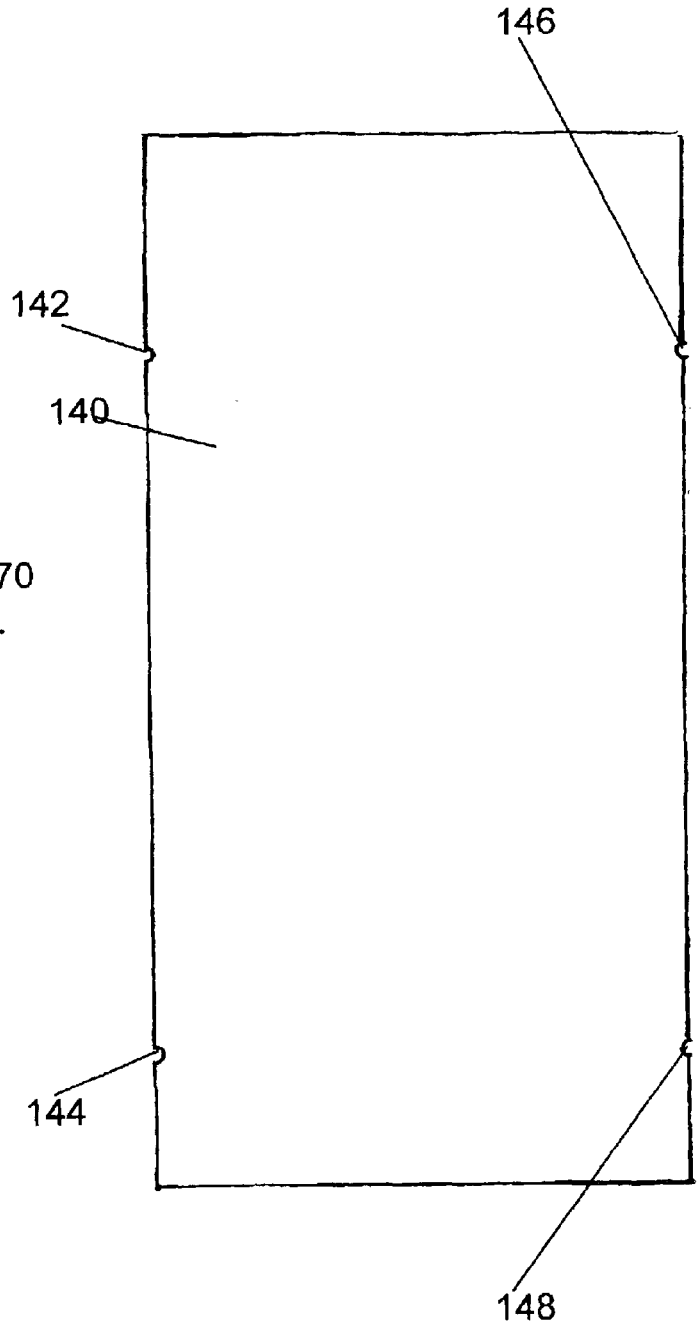
FIG. 7 is an elevational view of a liner for the panel of FIG. 2.

FIG. 3 is an end view of a concrete form 122 constructed using a first set of adjacent panels 124 and opposing set of adjacent panels 126. A plurality of the clamps 70 secure the horizontal walers to the panels. Concrete is poured into space 130 between the sets of panels. Tie bars 132 and 134 extend through the space between the sets of adjacent panels. The tie bars extend through the apertures 120 shown in FIG. 1. The panels are optionally provided with liners 140 as shown in FIG. 7 which may be, for example, of plastic or elastomeric material. In this example the liners are the same size as each of the panels. The liners have recesses 142, 144, 146 and 148 corresponding in size and position to the recesses 110, 112, 114 and 116 of each panel. These recesses therefore form apertures corresponding in size and position to the apertures 130. Accordingly the tie bars can extend through the apertures without requiring the liners to be punctured. This means that the liners can be reused again and again.

In the conventional manner, a series of vertical walers are connected to the horizontal walers, for example vertical walers 150 and 152 of FIG. 1. In the known manner each of the horizontal walers has a slot 154 extending therealong. Bolts extend through the slots and engage plates which fit over flanges on the vertical walers. The bolts have nuts on the outer ends thereof which are tightened to secure the vertical walers to the horizontal walers. This arrangement is well known and therefore is not described in more detail.

In use, a series of the panels are laid out on the ground in side-by-side relationship similar to the three panels of FIG. 1. The horizontal walers are then positioned on the panels between the buttons such as the buttons 50 and 52 shown in FIG. 2. The clamps 70 are used to connect the horizontal walers to the panels in the position shown in FIG. 1. The vertical walers are then connected to the horizontal walers as also shown in FIG. 1. The assembly can then be lifted into position to comprise one side of a concrete form as shown in FIG. 3.

It will be understood by someone skilled in the art that many of the details described above are by way of example only and can be varied or deleted without departing from the scope of the invention which is to be interpreted with reference to the following claims.

What is claimed is:

1. A concrete form apparatus, comprising:

a plurality of adjacent rectangular panels, each said panel having a first edge and a second edge, spaced-apart first connector elements adjacent to the first edge of each said panel, and spaced-apart second connector elements adjacent to the second edge of each said panel, the first connector elements being aligned with the second connector elements and being complementary in structure, corresponding first and the second connector elements of adjacent panels engaging each other and connecting the plurality of said panels together with the first and second edges thereof adjacent to each other, and third connector elements connected to each said panel in spaced-apart relationship; each said panel having a plurality of spaced-apart recesses along the first edge and a plurality of spaced-apart recesses along the second edge, the recesses of the first edge being aligned with the recesses of the second edge whereby apertures for tie bars are formed by the recesses between adjacent first and second edges of adjacent panels, the recesses being semicircular and the apertures being circular;

a plurality of spaced-apart first walers extending across the plurality of panels; and a plurality of clamps engaging the third connector elements of the panels and connecting the walers to the panels, the clamps having slots which engage the third connector elements, each of the clamps having a U-shaped body which fits over one of the walers.

2. The concrete form apparatus as claimed in claim 1, wherein said each clamp has a pair of spaced-apart first ends adjacent to one of the panels, each of the first ends having one of the slots, and a second end distal from said one of the panels, said one of the walers being between the first ends and the second end.

3. The concrete form apparatus as claimed in claim 2, wherein said each clamp has a screw threadedly received in the second end thereof, the screw engaging said one of the walers.

4. A concrete form apparatus, comprising:

a plurality of adjacent rectangular panels, each said panel having a first edge and a second edge, spaced-apart first connector elements connected to the panels adjacent to the first edge of each said panel, spaced-apart second connector elements connected to the panels adjacent to the second edge of each said panel, the first connector elements being aligned with the second connector elements and being complementary in structure, corresponding first and the second connector elements of adjacent panels engaging each other and connecting the plurality of said panels together with the first and second edges thereof adjacent to each other, and third connector elements connected to each said panel in spaced-apart relationship; wherein each said panel has a plurality of spaced-apart recesses along the first edge and a plurality of spaced-apart recesses along the second edge, the recesses of the first edge being aligned with the recesses of the second edge whereby apertures for tie bars are formed by the recesses between adjacent first and second edges of adjacent panels, the tie bars extending through the apertures only and unperforated liners extending over the panels between the tie bars;

a plurality of spaced-apart first walers extending across the plurality of panels; and a plurality of clamps engaging the third connector elements of the panels and connecting the walers to the panels.

5. The concrete form apparatus as claimed in claim 4, wherein the first connector elements are hook-like latches and the second connector elements are buttons.

6. The concrete form apparatus as claimed in claim 4, wherein the third connector elements are buttons.

7. The concrete form apparatus as claimed in claim 4, wherein the recesses are semicircular and the apertures are circular.

8. The concrete form apparatus as claimed in claim 6, wherein the clamps have slots which engage the third connector elements.

9. The concrete form apparatus as claimed in claim 4, including a plurality of second walers on the first walers and perpendicular thereto, the second walers being connected to the first walers.

10. A concrete form apparatus, comprising:

a rectangular panel having first connector elements connected to the panel along a first edge thereof and second connector elements connected to the panel along a second edge thereof, the first connector elements being aligned with the second connector elements and being complementary in structure, whereby the first and the second connector elements can connect a plurality of said panels together with the first and second edges thereof adjacent to each other; third connector elements being connected to said panel in spaced-apart relationship and being engageable with clamps for securing walers to the panel, the panel having a plurality of spaced-apart recesses along the first edge and a plurality of spaced-apart recesses along the second edge, the recesses of the first edge being aligned with the recesses of the second edge whereby apertures for tie bars are formed by the recesses between adjacent first and second edges of adjacent panels, the panels being configured to receive unperforated liners between the recesses.

11. The concrete form apparatus as claimed in claim 10, wherein the first connector elements are hook-like latches and the second connector elements are buttons.

12. The concrete form apparatus as claimed in claim 10, wherein the third connector elements are buttons.

13. A concrete form apparatus as claimed in claim 10, wherein the panel has an exterior, the connector elements being connected to the exteriors of the panels.

14. A concrete form apparatus, comprising:

a plurality of adjacent rectangular panels, each said panel having a first edge and a second edge, spaced-apart first connector elements adjacent to the first edge of each said panel, spaced-apart second connector elements adjacent to the second edge of each said panel, the first connector elements being aligned with the second connector elements and being complementary in structure, corresponding first and the second connector elements of adjacent panels engaging each other and connecting the plurality of said panels together with the first and second edges thereof adjacent to each other, and third connector elements connected to each said panel in spaced-apart relationship;

a plurality of spaced apart first walers extending across the plurality of panels;

a plurality of second walers on the first walers and perpendicular thereto, bolts connecting the second walers to the first walers; and a plurality of clamps engaging the third connector elements of the panels and connecting the first walers to the panels.

* * * * *